United States Patent [19]

Rosborough, Jr. et al.

[11] 3,955,735

[45] May 11, 1976

[54] APPARATUS FOR OPENING EXPENDABLE FILM CARTRIDGES

[75] Inventors: Robert S. Rosborough, Jr.; Mark J. Devaney, both of Rochester; Luther M. Wright, Brockport, all of N.Y.

[73] Assignee: Eastman Kodak Company, Rochester, N.Y.

[22] Filed: Oct. 25, 1973

[21] Appl. No.: 409,507

[52] U.S. Cl. ..... 225/103

[51] Int. Cl.² ..... B26F 3/00

[58] Field of Search ..... 225/93, 96.5, 103, 104, 225/105, 2

[56] References Cited

UNITED STATES PATENTS

| | | | |
|---|---|---|---|
| 3,494,519 | 2/1970 | Koehler | 225/93 |
| 3,580,443 | 5/1971 | Hennig | 225/96.5 |
| 3,722,768 | 3/1973 | Schnellman | 225/105 |
| T925,002 | 8/1974 | Rosborough, Jr. et al. | 225/103 |

*Primary Examiner*—Travis S. McGehee
*Assistant Examiner*—Leon Gilden
*Attorney, Agent, or Firm*—S. W. Gremban

[57] ABSTRACT

A method and apparatus for opening expendable film cartridges of the type having film supply and take-up chambers joined by a hollow intermediate part having an exposure aperture. The cartridge opening apparatus has a support head for supporting a cartridge, film sensing means for sensing the type of film in the cartridge, and a movable spindle and chisel responsive to the sensing means if the film is the correct type for substantially simultaneously positioning and opening the film take-up chamber.

5 Claims, 17 Drawing Figures

APPARATUS FOR OPENING EXPENDABLE FILM CARTRIDGES

BACKGROUND OF THE INVENTION

1. Field of the Invention

This invention relates generally to container opening devices, and more specifically to an improved method and apparatus for opening expendable film magazines.

2. Description of the Prior Art

It is known in the prior art to provide an expendable film cartridge made of plastic or other frangible material of the type generally disclosed in U.S. Pat. No. 3,260,182. The film cartridge comprises front and back members which when joined along a line of separation form a film supply chamber in which a coil of interleaved backing paper and film is located when the cartridge is loaded at the factory, a film take-up chamber rotatably supporting a spool onto which the film is wound, and a hollow intermediate part having an exposure aperture across which the film is advanced from the supply chamber to the take-up spool. The line of separation of the front and back members extends around the cartridge except at those portions of the take-up chamber of the cartridge which embrace grooved flanges at the ends of the take-up spool in light-tight relation. At the line of separation at the outer end of the take-up chamber, the front and back members are secured together only at the ends thereof adjacent the aforementioned take-up chamber portions, the intermediate part of such line of separation having unsecured light-tight interfitting ribs. The intermediate part of the cartridge is preferably provided with one or more notches for identifying the type of film contained in the cartridge.

It is further known in the art as exemplified by U.S. Pat. No. 3,580,443 to provide an apparatus for opening film cartridges of the aformentioned type. In such cartridge opening apparatus, a support mechanism including a spindle holds the cartridge in a predetermined position, a tool having a cutting edge is moved into engagement with the line of separation at the outer end of the cartridge and penetrates the cartridge to produce a crack therein, and means are provided for moving the tool in relation to the housing so that the crack is propagated until the housing is sufficiently opened to permit evacuation of the spool carrying the exposed film. Although such a cartridge opening apparatus is believed to operate satisfactorily, some of the disadvantages of such apparatus are its relatively complicated construction, its large number of precision made parts, and its high cost of manufacture and maintenance. In addition, the propagation of the initial crack in the housing is believed to provide a source of plastic chips which might become inadvertently engaged with the exposed film to scratch or otherwise damage it during the presplicing or processing operations.

It is further known in the art to provide a cartridge opening device having sensing means for sensing notches or the like in the cartridge to determine the type of film contained therein, and if the proper film is sensed to enable the cartridge opening device so that it can be operated to open the cartridge.

SUMMARY OF THE INVENTION

In accordance with a preferred embodiment of the invention, an apparatus is disclosed for opening expendable film cartridges. The cartridges are of known type having supply and take-up chambers connected by an intermediate part wherein said take-up chamber has a spool for receiving film wound thereon from the supply chamber. The cartridge opening apparatus is provided with a cartridge supporting means for supporting the cartridge with a bore of the spool substantially in alignment with opposed, axially aligned spool supporting spindles. The spindles are insertable within the bore of the spool for positioning and retaining the take-up chamber in a cartridge opening position. With the chamber in the cartridge opening position, oppositely mounted chisels are moved into engagement with the take-up chamber for cracking open the ends of the chamber whereby the depending portion of the take-up chamber can be hingedly moved relative to the remainder of the cartridge for opening the chamber at the line of separation. In a more specific embodiment of the invention, the cartridge supporting means and cartridge are movable relative to the spindles after the cartridge take-up chamber is opened for separating the cartridge from the spool. In another embodiment of the invention, a spindle and a chisel are mounted on a movable member for movement together as a unit. In still another embodiment of the invention, the movable member is movable on an axis parallel to the axis of the spool, and the spindle and chisel are both mounted on the member in spaced relation, and extend axially therefrom parallel to the spool axis. In a more specific embodiment of the invention, the movable member comprises a reciprocally movable piston, and the spindle and spool axes are substantially coincident when the cartridge is in the cartridge opening position. In still another embodiment of the invention, the cartridge supporting means comprises a block having air jets directed against the cartridge, and the cartridge opening apparatus has sensing means for sensing a film type code on the cartridge. If the proper code is sensed, the moving means is actuated for opening the chamber.

In accordance with a preferred method of this invention, the operator initially places a film cartridge on the cartridge supporting means. The film type code on the cartridge is sensed by a sensing means, and if the proper code is sensed, oppositely mounted spindles and chisels are moved toward the cartridge for substantially simultaneously positioning the cartridge and opening the chamber. The spindles and chisels are then partially retracted withdrawing the chisels from the housing but retaining the spindles within the spool bore. The cartridge supporting means is then moved laterally relative to the spindles withdrawing the cartridge from the spindled spool. After the film is removed from the spool, the chisels and spindles are retracted to their original normal position discarding the spool, and the cartridge supporting means is returned to its initial loading position for receiving another cartridge. During such return of the cartridge supporting means to its loading position, the sensing means is inactivated to prevent inadvertent operation of the mechanism for moving the spindle and chisels toward the supporting means.

One of the objects and advantages of the present invention is to provide an improved method and apparatus for opening expendable film cartridges that is of simple design and construction, thoroughly reliable and efficient in operation, and economical to manufacture.

Another object and advantage of this invention is to provide an improved cartridge opening device that minimizes the formation of plastic chips during the cartridge opening operation, and possible scratching and damaging of the film.

Still another object and advantage of the invention is to provide an improved cartridge opening apparatus that is operative to open a film cartridge only when the cartridge contains a predetermined film type.

The invention and its objects and advantages will become more apparent from the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Because film cartridge opening devices are well known, the present description will be directed in particular to elements forming part of, or cooperating more directly with, the method and apparatus in accordance with the present invention. Elements of a cartridge opening apparatus not specificially shown or described herein should be understood to be selectable from those known in the art.

Figure 5:
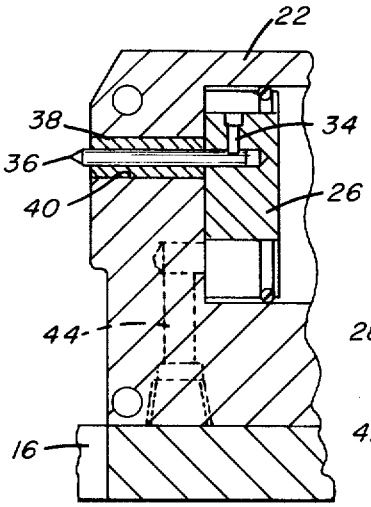
FIG. 5 is a segmental view in section taken substantially along line 5—5 of FIG. 1.
Figure 6:
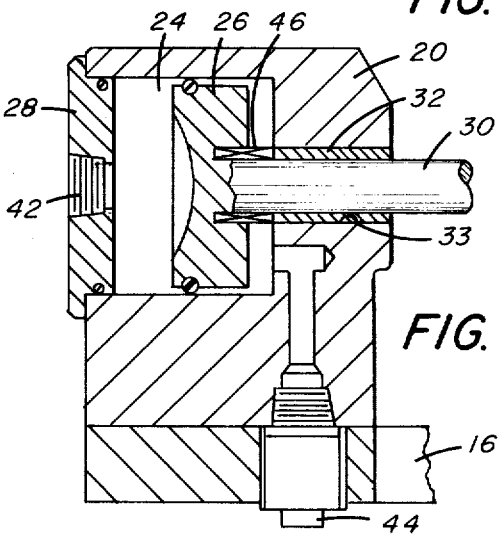
FIG. 6 is a segmental view in section taken substantially along line 6—6 of FIG. 1.
Figure 9:
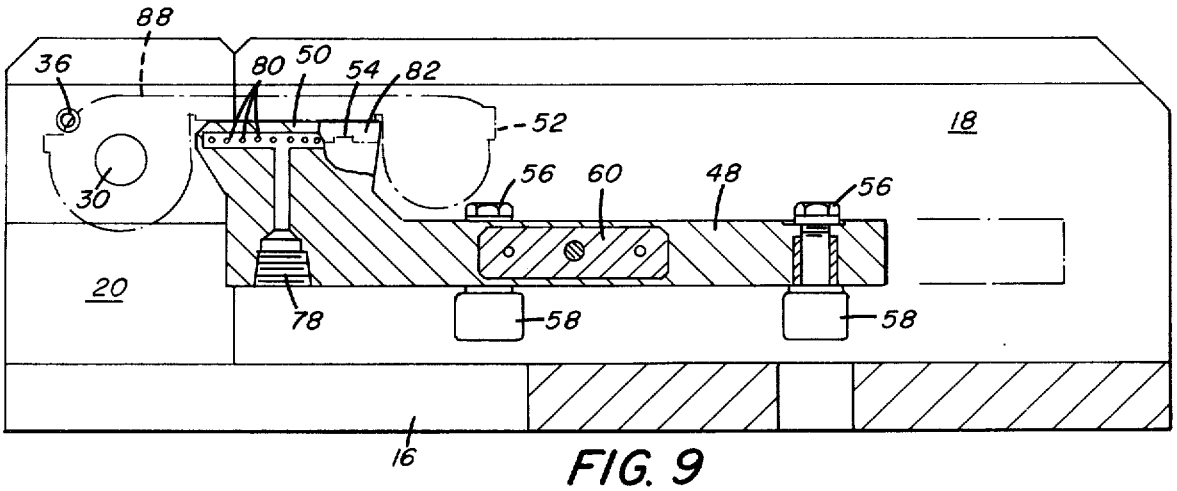
FIG. 9 is a side elevational view partially in section taken substantially along line 9—9 of FIG. 1.
Figure 10:
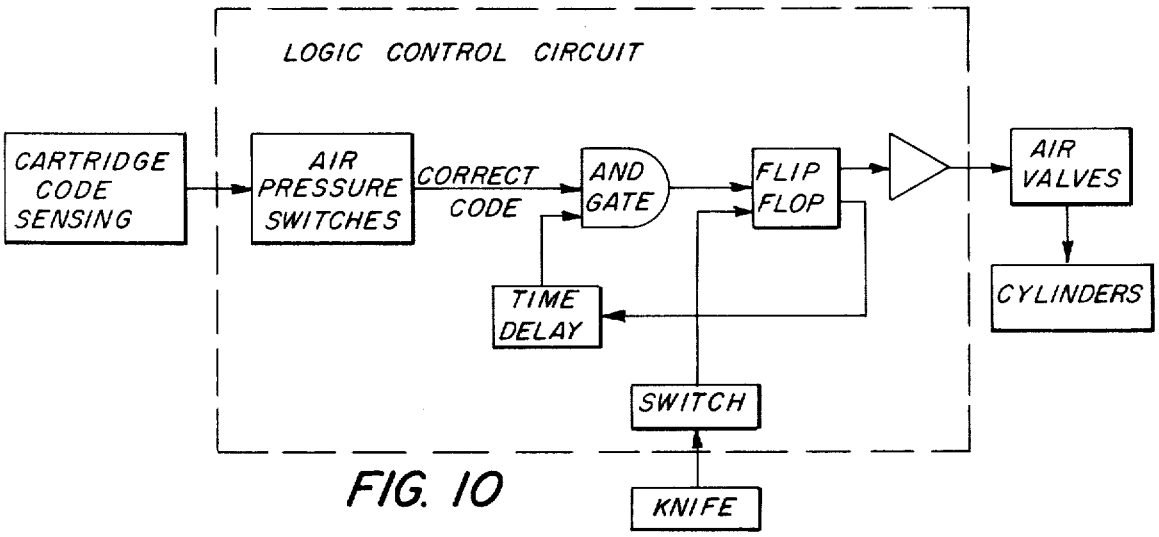
FIG. 10 is a circuit block diagram of the control circuit for the cartridge opening mechanism of this invention.
Figure 11:
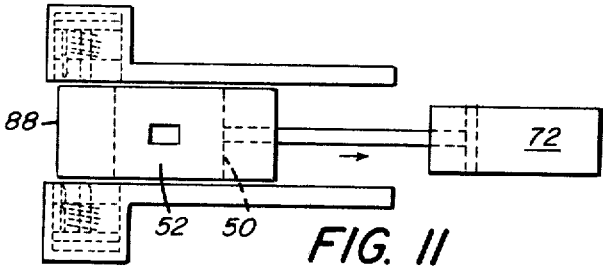
FIG. 11 is a top plan view in schematic form of the cartridge opening mechanism in its initial position with a cartridge placed thereon.
Figure 12:
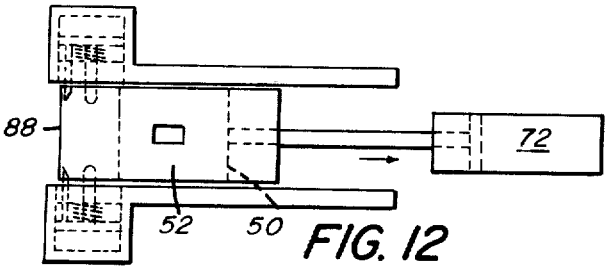
FIG. 12 is a view similar to FIG. 11 with the cartridge mechanism in a cartridge breaking position.
Figure 13:
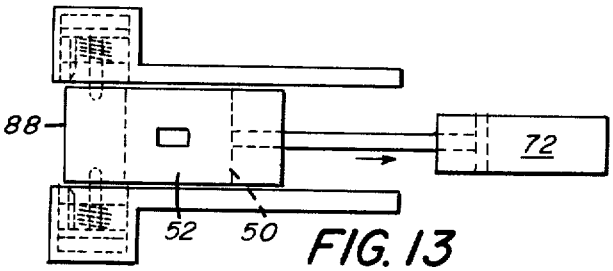
FIG. 13 is a view similar to FIG. 11 with the chisels retracted clear of the cartridge and with the spindles extending partially within the spool bore.

With reference to the drawings, a film cartridge opening apparatus is disclosed comprising a base plate 16 having an elongated support wall 18 secured thereto by any suitable means. A pair of housings 20, 22 are secured to one end of base plate 16 in spaced apart relation facing one another. Another housing 23 is secured to base plate 16 parallel to and spaced from wall 18. Each housing 20, 22 is provided with a cylinder 24 (FIG. 6) perpendicular to wall 18 for receiving a reciprocally movable piston 26 retained therein by a cylinder cap 28. Each of the pistons 26 has an axially extending spindle 30 journaled in a bearing 32 mounted in an opening 33 in the housing wall, and the spindles 30 are in axial alignment with one another. Also secured to piston 26 by a set screw 34 or the like as best seen in FIG. 5 is a laterally extending chisel blade 36 parallel to and radially spaced from the axis of spindle 30 (FIG. 9). The blade 36 is journaled in a bearing 38 mounted in an opening 40 extending through the housing wall. Air inlet and outlet ports 42, 44 (FIG. 6) are provided for each of the cylinders 26 connected via tubing and air valves to any suitable source of air pressure and exhaust. An annular spring 46 is interposed between piston 26 and one end of cylinder 24 for moving the piston to an intermediate position as illustrated in FIGS. 6 and 13 which is between a fully retracted position as seen in FIG. 11 and a cartridge opening position as seen in FIGS. 5 and 12. The operation of pistons 26 between the various positions is controlled by any suitable electromechanical control system such as the logic control circuit illustrated in FIG. 10.

Figure 1:
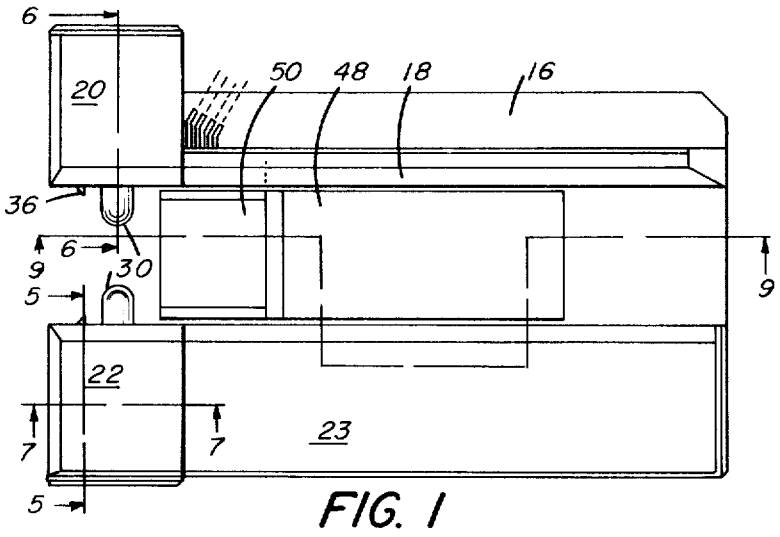
FIG. 1 is a top plan view of a cartridge opening device constructed in accordance with a preferred embodiment of this invention.
Figure 3:
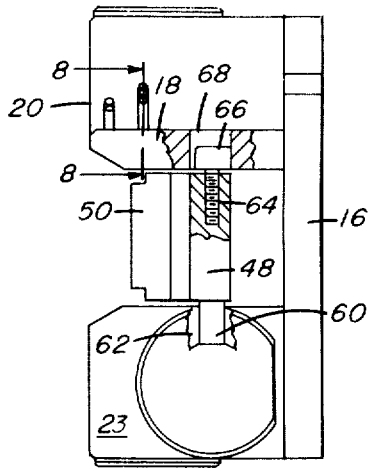
FIG. 3 is a right end elevational view of the film cartridge opening device of FIG. 1.
Figure 2:
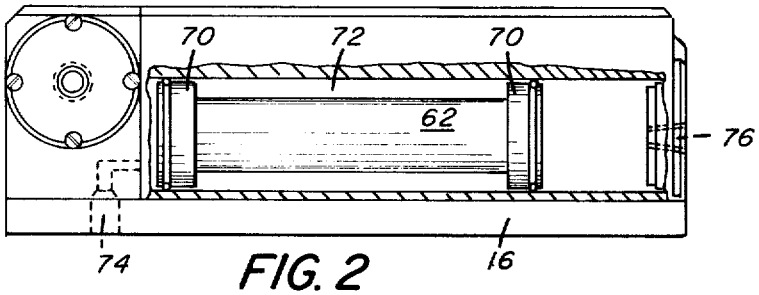
FIG. 2 is a side elevational view of the cartridge opening device of FIG. 1.
Figure 4:
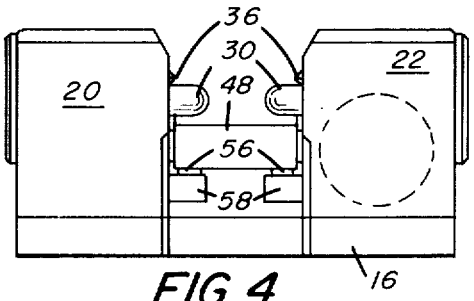
FIG. 4 is a left end elevational view of the film cartridge opening device of FIG. 1.
Figure 7:
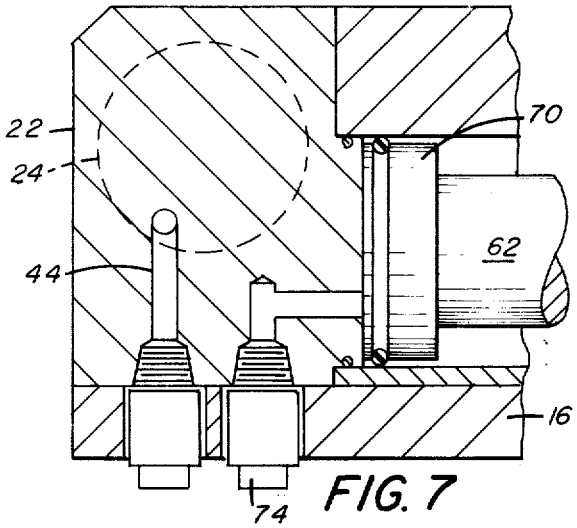
FIG. 7 is a segmental view in section taken substantially along line 7—7 of FIG. 1.
Figure 8:
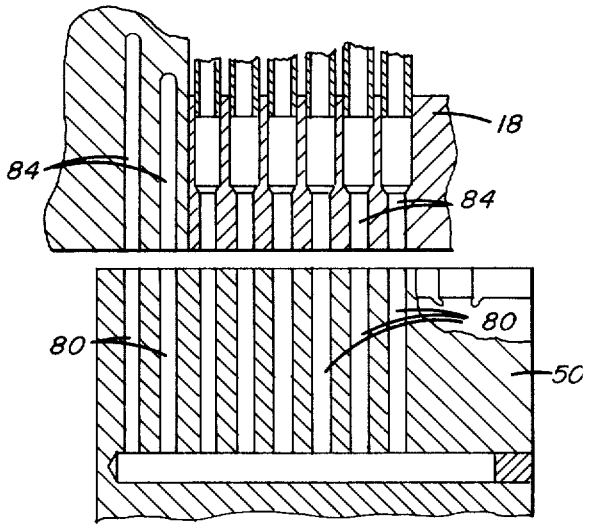
FIG. 8 is a segmental view in section taken substantially along line 8—8 of FIG. 3.

The cartridge opening apparatus is further provided with a cartridge supporting means which is interposed between and slidably supported by housing 23 and support wall 18. The cartridge supporting means as best illustrated in FIGS. 3, 4 and 9 comprises a substantially rectangular block 48 having an upwardly extending support head 50 at one end onto which a cartridge 52 to be opened is placed as illustrated in FIGS. 9 and 11. The head 50 is provided with a lug 54 on its upper surface (FIG. 9) engageable by a notch in cartridge 52 for precisely locating the cartridge on the head. The block 48 is provided with depending shafts 56 secured thereto for rotatably supporting rollers 58 engageable with the inwardly facing side surfaces of housing 23 and wall 18 for guiding the block for reciprocal movement as best seen in FIGS. 4 and 9. The block 48 is provided on one side with a laterally extending rib 60 (FIG. 3) extending through an elongated slot in the wall of housing 23 and secured to the body of a piston 62 by any suitable screws or the like. The opposite side of block 48 is provided with a stub shaft 64 (FIG. 3) for rotatably supporting a roller 66 ridable on the lower surface of an elongated slot 68 in support wall 18. The piston 62 is provided with a piston head 70 at each end (FIG. 2), and is mounted within an elongated cylinder 72 in housing 23. Air inlet and outlet ports 74, 76 respectively (FIGS. 2 and 7) are provided for cylinder 72 connected by tubing to a source of air pressure and to exhaust, and controlled by any suitable solenoid air valves connected to the tubing and operated by the logic control circuit for directing air into and exhausting air out of cylinder 72 for movement of piston 62 from one end of the cylinder to the other, and movement of the cartridge support block 48 between a normal cartridge loading position (FIGS. 9 and 11) and a retracted position (FIG. 14).

The cartridge opening device is further provided with a cartridge sensing mechanism for sensing the type of film in cartridge 52. If the cartridge contains a type of film that is compatible with the processing chemistry for which the processing apparatus is programmed, the cartridge opening apparatus will be actuated to break open the cartridge. However, if cartridge 52 contains a film type that is incompatible with the processing chemistry, the cartridge opening apparatus will not be actuated and any suitable signaling device such as an annunciator, not shown, will be actuated to alert the operator. The operator can then remove the unopened cartridge from the cartridge opening apparatus. The cartridge film type sensing mechanism as best illustrated in FIGS. 1, 3, 8 and 9 comprises an air inlet duct 78 in support head 50 terminating in a plurality of air supply orifices 80 for projecting an air flow against a cartridge wall 82 (FIG. 9). The housing wall 18 on the opposite side of cartridge wall 82 is provided with a plurality of air receiver orifices 84 in alignment with the aforementioned orifices 80 for receiving jets of air in those instances in which the cartridge wall 82 does not obstruct the air flow. The receiver orifices 84 are connected to any suitable air pressure switches, not shown, in the logic control circuit (FIG. 10) as is well known in the art. Accordingly, when a cartridge is mounted on head 50 having a wall 82 with a predetermined notch configuration defining a predetermined type of film for which the processing apparatus is programmed, the air jets passing through the cartridge wall notches will actuate the desired air pressure switches causing the logic control circuit to actuate the desired solenoid air valves for operating the cartridge opening apparatus. However if a cartridge 52 is placed in the cartridge opening apparatus having a wall notch configuration defining a different type of film, the logic control circuit will not trigger the solenoid air valves and the cartridge opening apparatus cannot be operated.

Figure 15:
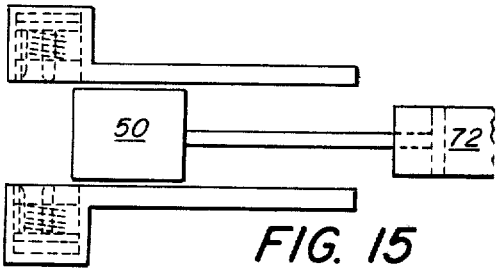
FIG. 15 is a plan view similar to FIG. 10 with the cartridge opening mechanism returned to its initial position for receiving a cartridge.
Figure 17:
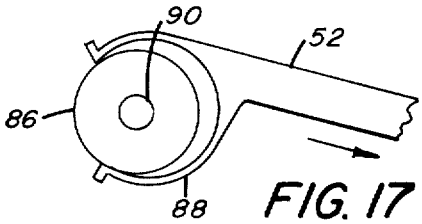
FIG. 17 is a fragmentary side elevational view illustrating the spreading of the take-up chamber as the cartridge is removed therefrom to the position illustrated in FIG. 14.
Figure 14:
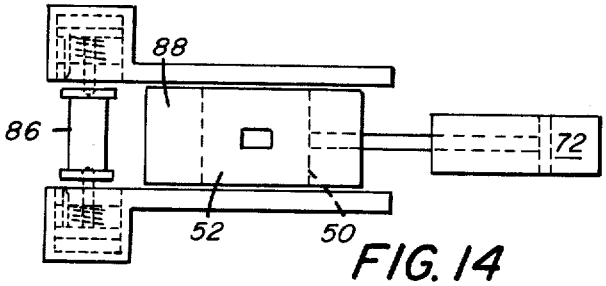
FIG. 14 is a view similar to FIG. 13 with the cartridge removed from the spindle spool.

In those instances where the cartridge opening apparatus is actuated by any suitable switch or the like to crack open a cartridge, the cartridge support block 48 pulls the cracked cartridge 52 away from the spindled cartridge spool 86 as best illustrated in FIGS. 14 and 17. The operator tips the empty cartridge 52 off of the cartridge support head 50 into a waste chute below. The operator then obtains the free end of the film from spindled spool 86, splices it to the trailing end of a stock roll and winds it thereon. The film end is cut free from the spool 86 and backing paper preferably by a hand-operated knife (FIG. 10). The downward stroke of the knife is designed to close a microswitch operating the solenoid air valves and pistons for retracting spindles 30 as best illustrated in FIG. 15 causing the scrap spool 86 and backing paper to drop into a waste chute, and for returning support block 48 to its initial cartridge loading position. A time-delay module in the logic control circuit is also actuated to prevent accidental triggering of the solenoid air valves as the air supply orifices 80 in the support head 50 pass back across the receiver orifices 84 in support wall 18 during return movement of support block 48 to its loading position.

Figure 10A:
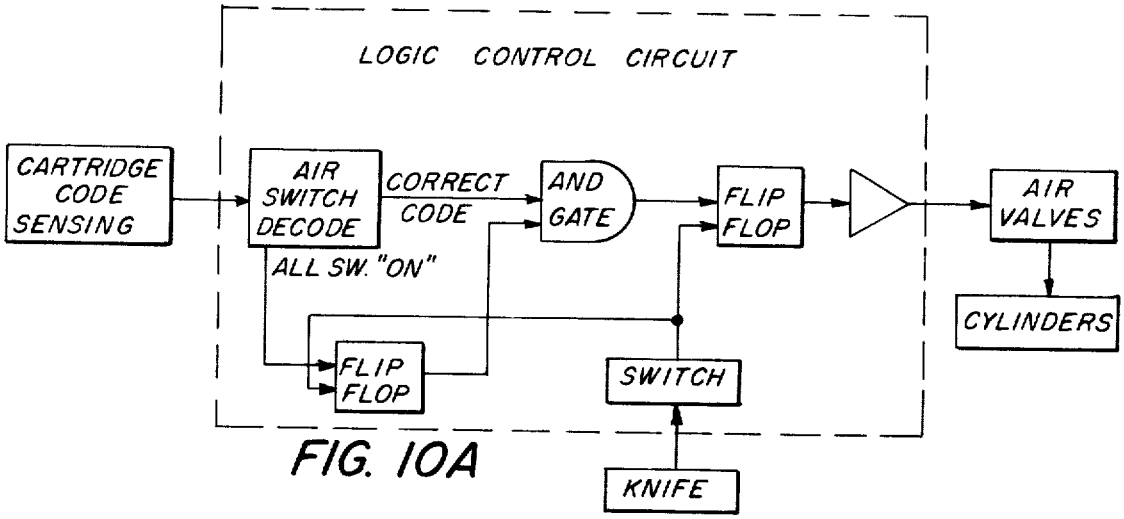
FIG. 10A is a circuit block diagram of another embodiment of the control circuit for the cartridge opening mechanism.
Figure 16:
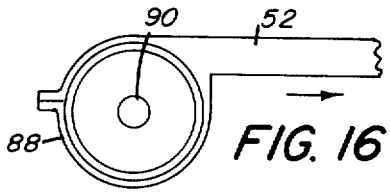
FIG. 16 is a fragmentary side elevational view of the cracked cartridge illustrated in FIG. 13.

With reference to FIGS. 11-15, the operational sequence of the cartridge opening apparatus will be described. In the normal cartridge loading position of the cartridge opening apparatus as illustrated in FIGS. 11 and 15, the spindles 30 and chisels 36 are completely retracted and support head 50 is fully advanced to the loading position. The operator places a cartridge 52 on head 50 and precisely positions it with the cartridge notch receiving head lug 54. If the cartridge contains a film type that is compatible with the processing chemistry of the processing apparatus, the cartridge code-sensing mechanism actuates the logic control circuit which in turn activates air cylinders 24. The air cylinders are moved from their retracted position to an advanced position (FIG. 12) in which the spindles 30 enter the bore 90 of spool 86 and chisels 36 break the cartridge cover along the ends of the takeup chamber 88 (FIG. 16). Following this action, air pressure is removed from cylinders 24 whereby compressed springs 46 move pistons 26 to an intermediate position (FIGS. 6 and 13) with chisels 36 retracted from take-up chamber 88. However, the spindles 30 still remain in spool bore 90. Following this operation, cylinder 72 is actuated for movement of piston 62 to its retracted position (FIG. 14) in which support head 50 pulls cartridge 52 away from spindled spool 86 (FIG. 17). The operator removes the film from spool 86, splices it to a stock roll, and winds it thereon. When the film end is reached, the operator cuts the film end from spool 86 and backing paper by the hand-operated knife (FIG. 10). The downward stroke of the knife actuates a switch for actuating a flip-flop energizing the solenoid air valves for withdrawing spindles 30 to their retracted position allowing the scrap spool 86 and backing paper to drop into a waste chute. The switch further de-energizes a solenoid air valve to allow cylinder 72 to return support head 50 to its normal loading position (FIG. 15) for receiving another cartridge 52. In addition, the flip-flop actuates a time-delay circuit in the logic circuit for inactivating the AND gate for a time period established by the time delay circuit, and thereby preventing accidental triggering of the solenoid air valves as the air supply orifices 80 on support head 50 pass across the receiver orifices 84 in support wall 18 during movement of the head to its loading position. Another circuit for preventing accidental triggering is illustrated in FIG. 10A in which the switch actuates a flip-flop for inactivating the AND gate for a sufficient time to allow head 50 to move to its loading position. At such time, the flip-flop is activated by all of the air switches being in their "on" position (no cartridge on head 50) to feed the proper signal in the AND gate so that it will operate when a cartridge is mounted on head 50 and a correct code is sensed by the cartridge code sensing system.

The invention has been described in detail with particular reference to a preferred embodiment thereof, but it will be understood that variations and modifications can be effected within the spirit and scope of the invention as described hereinabove.

We claim:

1. In a cartridge opening apparatus for opening cartridges of the type having supply and take-up chambers connected by an intermediate part wherein one of said chambers has a spool provided with a bore and containing film wound thereon, the combination comprising:

support means for supporting said cartridge;

spindle means separate from said support means and including a spindle movable while the cartridge is being supported by said support means to an active position in which said spindle is inserted within said bore of said spool of said cartridge for positioning and retaining said spool and said one chamber in a predetermined position, said spindle means further including a chisel movable to an active position for engaging and opening said one chamber;

means for moving said spindle and said chisel of said spindle means together as a unit to said active position for substantially simultaneously positioning the spool and said one chamber and opening said one chamber; and means for mounting said support means for movement relative to said spindle means in a direction transverse to the spindle axis after the said one chamber has been opened for separating said cartridge from said spool.

2. The invention according to claim 1 wherein said spindle means comprises a movable piston, and said spindle and said chisel are mounted on said piston.

3. The invention according to claim 1 wherein said spindle means comprises a piston movable on an axis parallel to the axis of said spool, and said spindle and said chisel are mounted on said piston and extend axially therefrom parallel to said spool axis.

4. The invention according to claim 3 wherein said piston is reciprocally movable, and said spindle axis and said spool axis are substantially coincident.

5. The invention according to claim 1 wherein said intermediate part of said cartridge has a wall provided with code notches therein indicating the type of film on said reel, said supporting means comprises a block having air jets directed against said wall, and said cartridge opening apparatus further has sensing means for sensing said cartridge code notches and if the proper code is sensed actuating said moving means for opening said one chamber.

* * * * *